US005926978A

United States Patent [19]

Smith

[11] Patent Number: 5,926,978

[45] Date of Patent: Jul. 27, 1999

[54] ATHLETIC SHOE HAVING A HINGEDLY ATTACHED TOE ENCLOSURE

[76] Inventor: Rudolph Smith, 8624 Cadillac Ave., Los Angeles, Calif. 90034

[21] Appl. No.: 09/020,030

[22] Filed: Feb. 6, 1998

[51] Int. Cl.[6] ..... A43B 3/24; A43B 11/00

[52] U.S. Cl. ..... 36/101; 36/138; 36/50.1; 36/54

[58] Field of Search ..... 36/101, 138, 50.1, 36/54, 110

[56] References Cited

U.S. PATENT DOCUMENTS

| | | |
|---|---|---|
| 660,284 | 10/1900 | Webber . |
| 1,012,017 | 12/1911 | Salt . |
| 3,000,116 | 9/1961 | Ally . |
| 4,373,275 | 2/1983 | Lydiard . |
| 4,958,447 | 9/1990 | DuPree . |
| 5,065,531 | 11/1991 | Prestridge . |
| 5,483,757 | 1/1996 | Frykberg . |
| 5,778,565 | 7/1998 | Holt et al. . |

FOREIGN PATENT DOCUMENTS

| | | |
|---|---|---|
| 736910 | 9/1955 | United Kingdom . |

*Primary Examiner*—Ted Kavanaugh
*Attorney, Agent, or Firm*—Beehler & Pavitt; David A. Belasco, Jr.; William H. Pavitt, Jr.

[57] ABSTRACT

The athletic shoe of the present invention is comprised of a resilient sole portion and an upper portion having an ankle enclosing section and a toe enclosing section. The ankle enclosing section arises from and is secured to the after end of the sole portion and includes a top portion defining an opening through which the wearer's foot may be introduced. The ankle enclosing section further includes an outer side an inner side. A flexible tongue member is attached to the inner side and extends laterally to the outer side. The ankle enclosing section includes a forward area having an opening through which the wearer's forefoot and toes will extend when the shoe is worn. The toe enclosing section is hingedly attached at is inner side to the inner edge of the resilient sole and may be swung upwardly to permit introduction or removal of the wearer's foot. The toe enclosing section is detachably secured to the outer edge of the sole portion at its outer side. A series of pins, each including a horizontally oriented retaining notch, descend from the lower edge of the outer side of the toe enclosing section. These pins are sized and positioned to engage a series of holes in a first retaining strip attached to the sole. A locking strip is slidably mounted above the first retaining strip. The locking strip includes a series of elongated holes and is of a thickness just slightly less than the retaining notch in the pin. A second retaining strip, having a series of beveled countersink holes arranged coaxially with the holes in the first retaining strip and the elongated holes in the locking strip, is positioned above the locking strip. When the toe enclosing section is closed over the wearer's foot, the locking strip is moved to a forward position and the rear edge of the elongated hole in the locking strip engages the retaining notch in the pin, thereby securing the pin from being withdrawn upwardly. A locking mechanism is provided to retain the locking strip in the forward position.

7 Claims, 3 Drawing Sheets

ATHLETIC SHOE HAVING A HINGEDLY ATTACHED TOE ENCLOSURE

FIELD OF INVENTION

The present invention relates to the field of shoes and foot coverings; more particularly, to athletic shoes providing a unique entry and closure system.

BACKGROUND OF THE INVENTION

As sporting activities become more performance oriented, the demands placed on sporting equipment become more sophisticated. The technical requirements for athletic shoes used in such events have tended to evolve in lock step with the advancement of such activities. Toward this end, various designs for athletic shoes, and more particularly designs for shoe closure systems have been developed.

U.S. Pat. No. 5,557,866, issued to Prengler on Sep. 24, 1996, illustrates athletic footwear having a hinged rear entry and associated fastening system. U.S. Pat. No. 4,616,432 issued to Bunch et al. on Oct. 14, 1986 shows an athletic shoe with a lace closure disposed along the side of the shoe rather than in a central location. U.S. Pat. No. 4,811,497, issued to Ciudad on Mar. 14, 1989, describes a sport shoe incorporating a series of flexible strips on the vamp of the shoe connected together with elastic material, providing a lace-less entry system. U.S. Pat. No. 5,177,882, issued to Berger on Jan. 12, 1993 illustrates a shoe with a central fastener used to secure a rigid instep cover which is drawn to the shoe upper with a series of cables.

In addition to these various closure mechanisms, a number of patents address methods for attaching the shoe upper to the sole. U.S. Pat. No. 2,444,640, issued to Epstein on Jul. 6, 1948, describes a zipper-type closure for attaching different toe enclosing portions of the upper to the sole. A similar system is used in U.S. Pat. No. 2,200,080, issued to Fein on May 7, 1940, to attach the entire upper to the sole of the shoe. U.S. Pat. No. 3,204,346, issued to Lockard et al. on Sep. 7, 1965, illustrates a groove and matching, sliding projection system for attaching the upper to the sole portion.

It is an objective of the present invention to provide an athletic shoe offering easily adjustable support to the wearer's ankle. It is a further objective of the invention to provide a means for the wearer to quickly put on and remove the shoe. It is a still further objective of the present invention to provide protection to the wearer's toes and forefoot from impacts to the upper surface of the shoe. It is yet a further objective of the invention to provide an athletic shoe with a unique and attractive appearance. While the prior art shoes examined provide a variety of useful features, none answer the requirements of the present invention.

SUMMARY OF THE INVENTION

The athletic shoe of the present invention incorporates a number of novel features which, taken together, address all of the objectives stated above. The athletic shoe may be constructed from three basic components, a resilient sole portion and an upper portion comprised of an ankle enclosing section and a toe enclosing section. The resilient sole portion has a forward end, an after end, an inner edge and an outer edge. A padded sole covering member is disposed above the sole portion The toe enclosing section has an inner side, an outer side, a top surface, a bottom surface, a back end and a lower edge joining the top surface and the bottom surface. The toe enclosing section is hingedly attached adjacent to the forward end of the sole portion at the lower edge along the inner side. The toe enclosing section is swingable from a first open position to a second closed position wherein the outer side of the toe enclosing section is secured to the outer edge of the sole portion. Means are provided for detachably securing the toe enclosing section adjacent to the forward end of the sole portion at its outer side.

The ankle enclosing section is secured to, and arises from, the after end of the resilient sole portion and has a forward area, a rear area, an inner side, an outer side and a top portion. The rear area has an inner surface and an outer surface and serves to enclose a wearer's heel and ankle. The front area serves to enclose the upper surface of the wearer's foot and includes an opening through which the wearer's forefoot and toes will extend when the shoe is worn. The top portion defining an opening through which the wearer's foot may be passed. The top portion has a first side and a second side and the first side of the top portion has a flexible tongue member attached to it and extending laterally from the first side to the second side. Means are provided for adjustably closing and tightening the ankle enclosing section and for securing the toe enclosing section to the ankle enclosing section when the toe enclosing section is swung to its second position.

In a variant of the present invention, the means for detachably securing the toe enclosing section to the forward end of the sole portion comprises a series of components. The first component is a series of pins attached adjacent the lower edge on the outer side of the toe enclosing section and extending downwardly from the edge. The pins have a front side and a back side and include a retaining notch of a predetermined size, the notch extending partially into the back side of the pin. The retaining notch is positioned orthogonal to the long axis of the pin.

The next component is a first retaining strip that is affixed to the forward end of the sole portion adjacent to its outer edge. The first retaining strip has a series of holes through it, the holes being sized and positioned to receive the pins. Next, the means includes a locking strip that has a front end and a rear end and is slidably positioned above the first retaining strip. The locking strip is of a thickness slightly less than the predetermined size of the retaining notch and includes a series of elongated holes each having a front edge and a rear edge. The elongated holes are sized and positioned to receive the pins. When the locking strip is moved to a forward position the rear edge of the elongated hole detachably engages the retaining notch. When the locking strip is moved to a rearward position the rear edge of the elongated hole is disengaged from the retaining notch and the pin may be withdrawn upwards.

The next component is a second retaining strip that has an upper surface and is positioned above the locking strip and disposed below the padded sole covering member. The second retaining strip has a series of holes that are sized and positioned to receive the pins. The first and second retaining strips serve to stabilize the locking of the pin when the locking strip is moved to the forward position. This stabilization is provided by supporting the front side of the pin when pressure is applied to the pin by the rear edge of the elongated hole bearing against the retaining notch. Means are provided for securing the locking strip in the forward position.

In another variant of the present invention, the means for securing the locking strip in the forward position comprises two components. The first component is a resilient strip that has a first end, a second end and an upper surface. The resilient strip is affixed to the rear end of the locking strip at the first end, at an acute angle to the strip. The resilient strip includes a locking projection affixed to its upper surface. The second component is a rigid plate that has an inner surface and an outer surface and is affixed at the inner surface to the outer surface of the ankle enclosing section. The plate has an orifice through it sized to slidably accommodate the rear end of the locking strip, the attached resilient strip and the locking projection when the resilient strip is compressed against the rear end of the locking strip.

The locking projection is positioned so that when the locking strip is moved to the forward position with the resilient strip compressed and the rear edge of the elongated hole engaging the retaining notch in the pin and the resilient strip is then released, the locking projection will be positioned inside of the orifice and bear against the inner surface of the rigid plate. This serves to secure the locking strip in the forward position and locking the pin within the first retaining strip and the second retaining strip. When the resilient strip is compressed against the locking strip the locking projection may pass through the orifice. The locking strip may now be withdrawn rearwardly, thereby disengaging the elongated hole of the locking strip from the retaining notch and permitting the pin to be withdrawn upwardly from the hole in the first and second retaining strips.

In yet another variant of the present invention, the means for adjustably closing and tightening the ankle enclosing section comprises at least one flexible strap of a predetermined length. The strap has a first end and a second end. The flexible strap is fixedly attached at the first end to the outer side of the ankle enclosing section. The flexible strap has a VELCRO®-type hooking strip attached at the second end. A VELCRO®-type loop strip fixedly attached to the inner side of the ankle enclosing section. The loop strip is positioned to detachably engage the hooking strip when the flexible strap is positioned across the ankle enclosing section. When the wearer's foot is inserted into the shoe the flexible strap may be drawn across the ankle enclosing section to adjustably secure its closure.

In still another variant of the invention the means for securing the toe enclosing section to the ankle enclosing section comprises at least one VELCRO®-type loop strip fixedly attached to the top portion of the ankle enclosing section adjacent its forward area. At least one VELCRO®-type hooking strip is affixed to the bottom surface of the toe enclosing section adjacent to its back end. The hooking strip is positioned to detachably engage the loop strip attached to the ankle enclosing section.

When the hingedly attached toe enclosing section is secured over the wearer's toes and forefoot, the hooking and loop strips serve to secure the toe enclosing section to the ankle enclosing section. When the hingedly attached toe enclosing section is opened upwardly the wearer may rapidly remove his foot.

In yet a further variant of the present invention, the means for detachably securing the toe enclosing section to the forward end of the sole portion at the outer side further comprises a V-shaped rib that connects the pins and a mating V-shaped groove in the sole covering member. The rib and the mating groove facilitate alignment of the pins with the second retaining strip. The variant also includes a plurality of beveled, countersink holes in the upper surface of the second retaining strip. The countersink holes are positioned coaxially with the plurality of holes in the second retaining strip.

When the toe enclosing section is lowered to enclose the wearer's toes and forefoot the countersink holes serve to facilitate the alignment of the pins with the holes in the second retaining strip.

In a final variant of the invention the toe enclosing section further comprises at least one resilient reinforcing member affixed to its bottom surface. The reinforcing member serves to provide a measure of rigidity to the toe enclosing section and protection for the forefoot and toes of the wearer.

DETAILED DESCRIPTION OF THE PREFERRED EMBODIMENT

Figure 1:
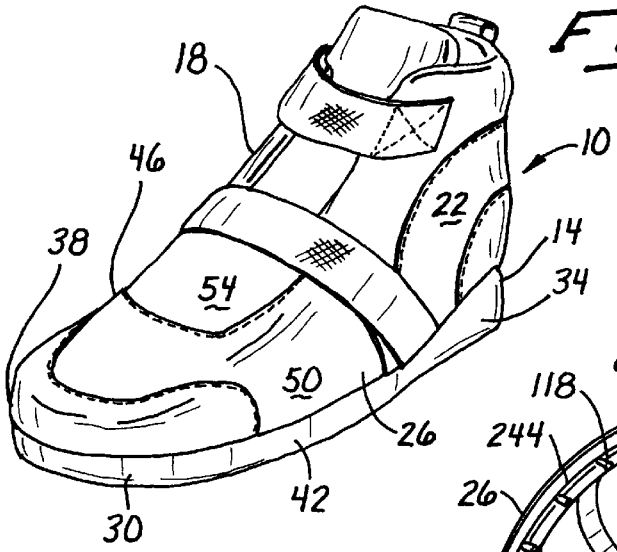
FIG. 1 is a perspective view of the athletic shoe of the present invention.
Figure 2:
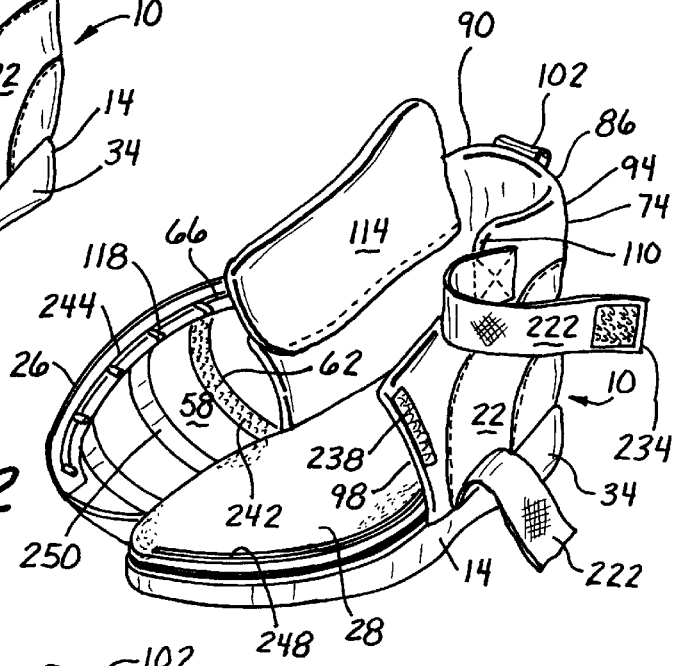
FIG. 2 is a perspective view of the FIG. 1 embodiment with the toe enclosing section and the ankle enclosing section in open positions to receive a wearer's foot.
Figure 3:
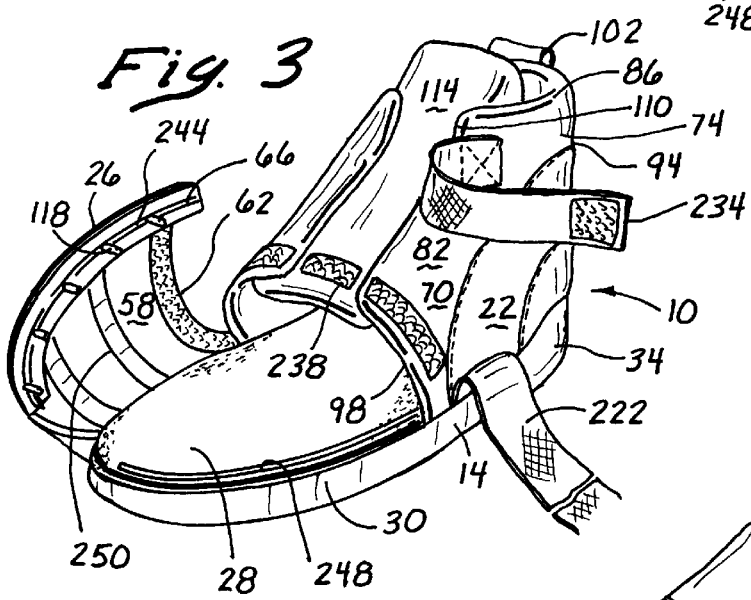
FIG. 3 is a perspective view of the FIG. 1 embodiment with the toe enclosing section in the open position and the ankle enclosing section in the closed position illustrating the position of the tongue member.
Figure 4:
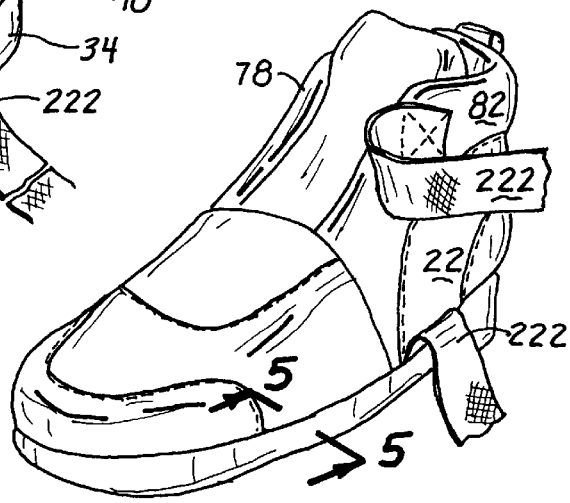
FIG. 4 is a perspective view of the FIG. 1 embodiment showing section line 5—5.
Figure 7:
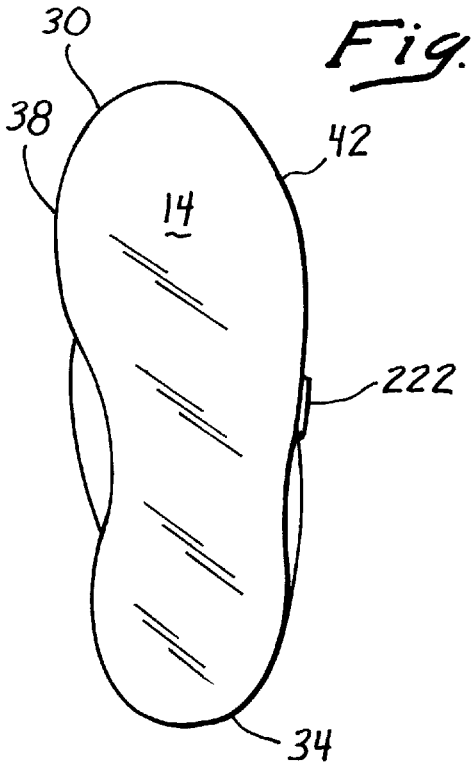
FIG. 7 is a bottom plan view of the athletic shoe.

As illustrated in FIGS. 1–3, the athletic shoe 10 may be constructed from three basic components, a resilient sole portion 14 and an upper portion 18 comprised of an ankle enclosing section 22 and a toe enclosing section 26. A padded sole covering member 28 is disposed above the sole portion 14. As shown in FIG. 7, the resilient sole portion 14 has a forward end 30, an after end 34, an inner edge 38 and an outer edge 42.

The toe enclosing section 26 has an inner side 46, an outer side 50, a top surface 54, a bottom surface 58, a back end 62 and a lower edge 66 joining the top surface 54 and the bottom surface 58. The toe enclosing section 26 is hingedly attached adjacent to the forward end 30 of the sole portion 14 at the lower edge 66 along the inner side 46. The toe enclosing section 26 is swingable from a first open position to a second closed position wherein the outer side 50 of the toe enclosing section 26 is secured to the outer edge 42 of the sole portion 14. Means are provided for detachably securing the toe enclosing section 26 adjacent to the forward end 30 of the sole portion 14 at its outer edge 42.

The ankle enclosing section 22 is secured to, and arises from, the after end 34 of the resilient sole portion 14 and has a forward area 70, a rear area 74, an inner side 78, an outer side 82 and a top portion 86. The rear area 74 has an inner surface 90 and an outer surface 94 and serves to enclose a wearer's heel and ankle. The forward area 70 serves to enclose the upper surface of the wearer's foot and includes an opening 98 through which the wearer's forefoot and toes will extend when the shoe 10 is worn. The top portion 86 defining an opening 102 through which the wearer's foot may be passed. The top portion 86 has a first side 106 and a second side 110 and the first side 106 of the top portion 86 has a flexible tongue member 114 attached to it and extending laterally from the first side 106 to the second side 110. Means are provided for adjustably closing and tightening the ankle enclosing section 22 and for securing the toe enclosing section 26 to the ankle enclosing section 22 when the toe enclosing section 26 is swung to its second position.

Figure 9:
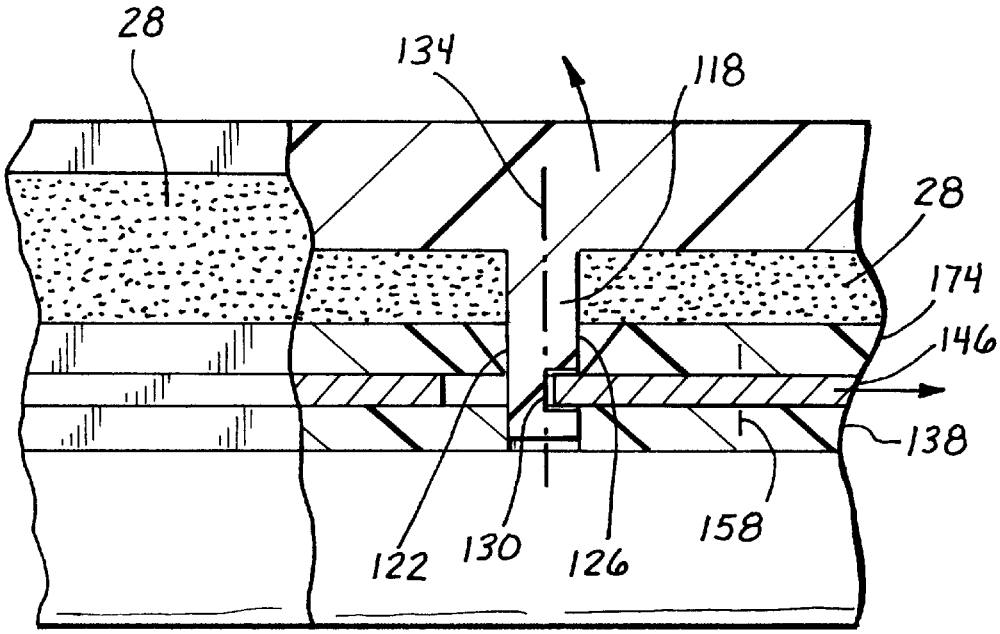
FIG. 9 is a cross-sectional detail of the means for detachably securing the toe enclosing section adjacent the forward end of the sole portion at its outer side taken along the line 9—9.

As shown in FIGS. 2, 3, 5, 6 and 9 the means for detachably securing the toe enclosing section 26 to the forward end 30 of the sole portion 14 comprises a series of components. The first component is a series of pins 118 attached to the lower edge 66 adjacent the outer side 50 of the toe enclosing section 26 and extending downwardly from the edge 66. As illustrated in FIG. 9, the pins 118 have a front side 122 and a back side 126 and include a retaining notch 130 of a predetermined size, the notch 130 extending partially into the back side 126 of the pin 118. The retaining notch 130 is positioned orthogonal to the long axis 134 of the pin 118.

The next component is a first retaining strip 138 that is affixed to the forward end 30 of the sole portion 14 adjacent to its outer edge. The first retaining strip has a series of holes 142 through it, the holes being sized and positioned to receive the pins 118. Next, the means includes a locking strip 146 that has a front end 150 and a rear end 154 and is slidably positioned above the first retaining strip 138. The locking strip 146 is of a thickness 158 slightly less than the predetermined size of the retaining notch 130 and includes a series of elongated holes 162 each having a front edge 166 and a rear edge 170. The elongated holes 162 are sized and positioned to receive the pins 118. When the locking strip 146 is moved to a forward position the rear edge 170 of the elongated hole 162 detachably engages the retaining notch 130. When the locking strip 146 is moved to a rearward position the rear edge 170 of the elongated hole 162 is disengaged from the retaining notch 130 and the pin 118 may be withdrawn upwards.

The next component is a second retaining strip 174 that has an upper surface 178 and is positioned above the locking strip 146 and disposed below the padded sole covering member 28. The second retaining strip 174 has a series of holes 182 that are sized and positioned to receive the pins 118. The first retaining strip 138 and second retaining strip 174 serve to stabilize the locking of the pin 118 when the locking strip 146 is moved to the forward position. This stabilization is provided by supporting the front side 122 of the pin 118 when pressure is applied to the pin 118 by the rear edge 170 of the elongated hole 162 bearing against the retaining notch 130. Means are provided for securing the locking strip 146 in the forward position.

Figure 8:
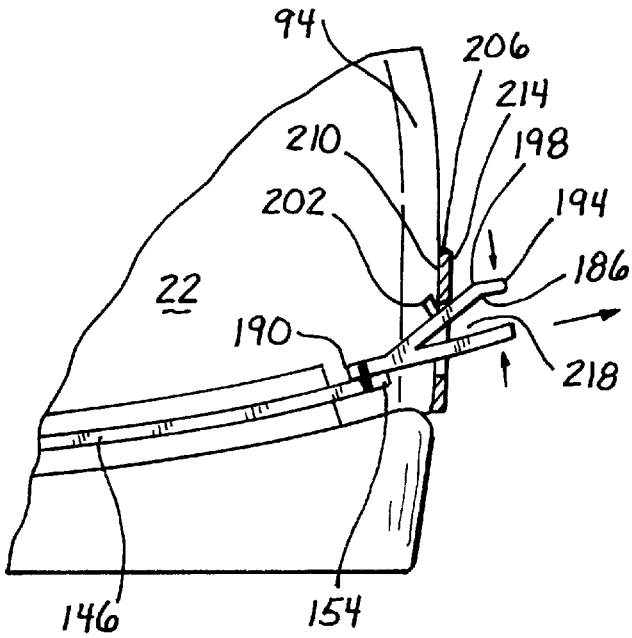
FIG. 8 is a side elevation of the ankle enclosing section illustrating the means for securing the locking strip in the forward position.

As illustrated in FIG. 8, the means for securing the locking strip 146 in the forward position comprises two components. The first component is a resilient strip 186 that has a first end 190, a second end 194 and an upper surface 198. The resilient strip 186 is affixed to the rear end 154 of the locking strip 146 at the first end 190, at an acute angle to the strip 146. The resilient strip 186 includes a locking projection 202 affixed to its upper surface 198. The second component is a rigid plate 206 that has an inner surface 210 and an outer surface 214 and is affixed at the inner surface 210 to the outer surface 94 of the ankle enclosing section 22. The plate 206 has an orifice 218 through it sized to slidably accommodate the rear end 154 of the locking strip 146, the attached resilient strip 186 and the locking projection 202 when the resilient strip 186 is compressed against the rear end 154 of the locking strip 146.

The locking projection 202 is positioned so that when the locking strip 146 is moved to the forward position with the resilient strip 186 compressed and the rear edge 170 of the elongated hole 162 engaging the retaining notch 130 in the pin 118 and the resilient strip 186 is then released, the locking projection 202 will be positioned inside of the orifice 218 and bear against the inner surface 210 of the rigid plate 206. This serves to secure the locking strip 146 in the forward position and locking the pin 118 within the first retaining strip 138 and second retaining strip 174. When the resilient strip 186 is compressed against the locking strip 146 the locking projection 202 may pass through the orifice 218. The locking strip 146 may now be withdrawn rearwardly, thereby disengaging the elongated hole 162 of the locking strip 146 from the retaining notch and permitting the pin to be withdrawn upwardly from the hole in the first retaining strip 138 and second retaining strip 174.

As shown in FIGS. 1, 2, 3, 4 and 6 the means for adjustably closing and tightening the ankle enclosing section 22 comprises at least one flexible strap 222 of a predetermined length. The strap 222 has a first end 226 and a second end 230. The flexible strap 222is fixedly attached at the first end 226 to the outer side 82 of the ankle enclosing section 22. The flexible strap 222 has a VELCRO®-type hooking strip 234 attached at the second end 230. A VELCRO®-type loop strip (not shown) is fixedly attached to the inner side 78 of the ankle enclosing section 22. The loop strip is positioned to detachably engage the hooking strip 234 when the flexible strap 222 is positioned across the ankle enclosing section 22. When the wearer's foot is inserted into the shoe 10 the flexible strap 222 may be drawn across the ankle enclosing section 22 to adjustably secure its closure.

Figure 6:
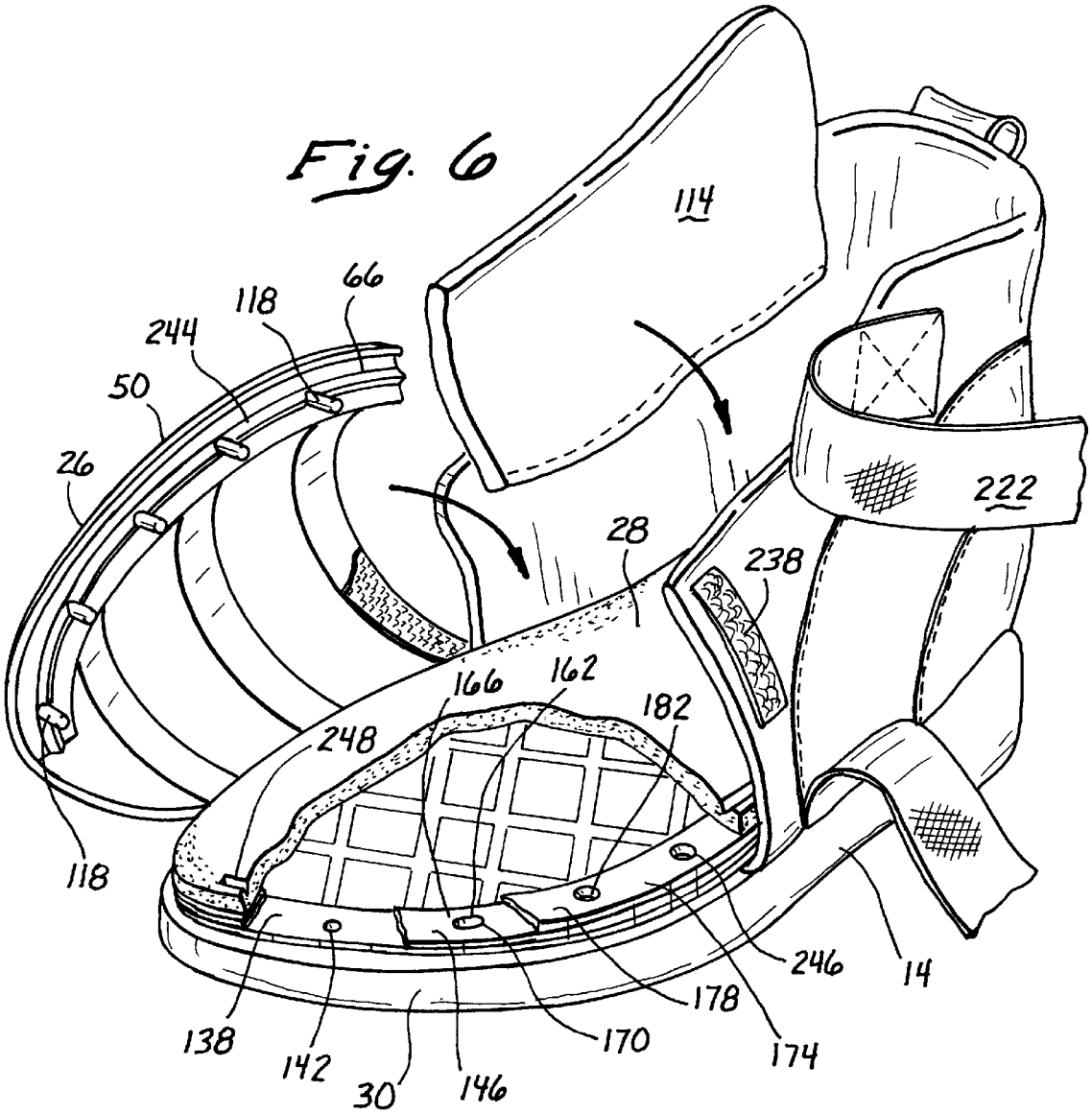
FIG. 6 is a perspective partial section of the FIG. 1 embodiment.

As illustrated in FIGS. 2, 3, and 6, the means for securing the toe enclosing section 26 to the ankle enclosing section 22 comprises at least one VELCRO®-type loop strip 238 fixedly attached to the top portion 86 of the ankle enclosing section 22 adjacent its forward area 70. At least one VELCRO®-type hooking strip 242 is affixed to the bottom surface 58 of the toe enclosing section 26 adjacent to its back end 62. The hooking strip 242 is positioned to detachably engage the loop strip 238 attached to the ankle enclosing section 22.

When the hingedly attached toe enclosing section 26 is secured over the wearer's toes and forefoot, the hooking strip 242 and loop strip 238 serve to secure the toe enclosing section 26 to the ankle enclosing section 22. When the hingedly attached toe enclosing section 26 is opened upwardly the wearer may rapidly remove his foot.

Figure 5:
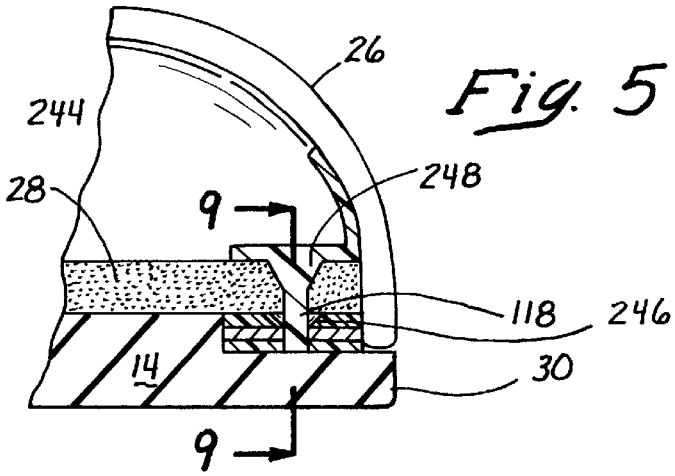
FIG. 5 is a cross-sectional front elevation of the FIG. 1 embodiment taken along the line 5—5.

As shown in FIGS. 2 and 6, a V-shaped rib 244 connects the pins and a mating V-shaped groove 248 in the sole covering member 28 facilitates alignment of the pins 118 with the second retaining strip 174. As illustrated in FIGS. 5 and 9, the means for detachably securing the toe enclosing section 26 to the forward end 30 of the sole portion 14 at the outer side 42, further comprises a plurality of beveled, countersink holes 246 in the upper surface 178 of the second retaining strip 174. The countersink holes 246 are positioned coaxially with the plurality of holes 186 in the second retaining strip 174.

When the toe enclosing section 26 is lowered to enclose the wearer's toes and forefoot the countersink holes 246 serve to facilitate the alignment of the pins 118 with the holes 186 in the second retaining strip 174.

As shown in FIGS. 2, 3 and 6, the toe enclosing section 26 further comprises at least one resilient reinforcing member 250 affixed to its bottom surface 58. The reinforcing member 250 serves to provide a measure of rigidity to the toe enclosing section 26 and protection for the forefoot and toes of the wearer.

I claim:

1. An athletic shoe, comprising:

a resilient sole member having a forward end, an after end, an inner edge and an outer edge;

a padded sole covering member disposed above said sole portion;

an upper portion having a toe enclosing section and the ankle enclosing section;

said toe enclosing section having an inner side, an outer side, a top surface, a bottom surface, a back end and a lower edge joining said top surface and said bottom surface;

said toe enclosing section being hingedly attached adjacent the forward end of the sole portion at the lower edge along the inner side;

said toe enclosing section being swingable from a first open position to a second closed position wherein the outer side of the toe enclosing section is secured to the outer edge of the sole portion;

means for detachably securing the toe enclosing section adjacent the forward end of the sole portion at its outer side;

the ankle enclosing section secured to, and arising from, the after end of said resilient sole portion and having a forward area, a rear area, an inner side, an outer side and a top portion;

said rear area having an inner surface and an outer surface and serving to enclose a wearer's heel and ankle;

said front area serving to enclose the upper surface of the wearer's foot and including an opening through which the wearer's forefoot and toes will extend when the shoe is worn;

said top portion defining an opening through which the wearer's foot may be passed;

said top portion having a first side and a second side;

said first side of said top portion having a flexible tongue member attached thereto and extending laterally from said first side to the second side;

means for adjustably closing and tightening said ankle enclosing section; and means for securing said toe enclosing section to said ankle enclosing section when the toe enclosing section is swung to its second position.

2. An athletic shoe as described in claim 1, wherein the means for detachably securing the toe enclosing section to the forward end of the sole portion further comprises:

a plurality of pins attached to the lower edge adjacent the outer side of the toe enclosing section and extending downwardly therefrom;

said pins having a front side and a back side and including a retaining notch of a predetermined size, said notch extending partially into the back side thereof;

said retaining notch being positioned orthogonal to the long axis of said pin;

a first retaining strip affixed to the forward end of the sole portion adjacent to the outer edge thereof;

said first retaining strip having a plurality of holes, said holes being sized and positioned to receive the pins;

a locking strip having a front end and a rear end and being slidably positioned above the first retaining strip;

said locking strip being of a thickness slightly less than the predetermined size of the retaining notch and including a plurality of elongated holes, said elongated holes having a front edge and a rear edge;

said elongated holes being sized and positioned to receive the pins;

whereby when the locking strip is moved to a forward position the rear edge of the elongated hole detachably engages the retaining notch and when the locking strip is moved to a rearward position the rear edge of the elongated hole is disengaged from the retaining notch and the pin may be withdrawn upwards;

a second retaining strip having an upper surface and positioned above the locking strip and disposed below the padded sole covering member;

said second retaining strip having a plurality of holes, said holes being sized and positioned to receive the pins;

said first and second retaining strips serving to stabilize the locking of the pin when the locking strip is moved to the forward position by supporting the front side of the pin when pressure is applied to the pin by the rear edge of the elongated hole bearing against the retaining notch; and means for securing the locking strip in the forward position.

3. An athletic shoe as described in claim 2, wherein the means for detachably securing the toe enclosing section to the forward end of the sole portion at the outer side further comprises:

a V-shaped rib connecting the pins;

a mating V-shaped groove in the sole covering member facilitating alignment of the pins with the second retaining strip;

a plurality of beveled, countersink holes, said countersink holes located in the upper surface of the second retaining strip and positioned coaxially with the plurality of holes therein; and whereby when the toe enclosing section is lowered to enclose the wearer's toes and forefoot said countersink holes serve to facilitate the alignment of the pins with the holes in the second retaining strip.

4. An athletic shoe as described in claim 2, wherein the means for securing the locking strip in the forward position comprises:

a resilient strip having a first end, a second end and an upper surface and being affixed to the rear end of the locking strip at said first end at an acute angle thereto;

said resilient strip including a locking projection affixed to said upper surface;

a rigid plate having an inner surface and an outer surface and being affixed at said inner surface to the outer surface of the ankle enclosing section;

said plate having an orifice therethrough sized to slidably accommodate the rear end of the locking strip, the attached resilient strip and the locking projection when the resilient strip is compressed against the rear end of the locking strip;

said locking projection being positioned so that when the locking strip is moved to the forward position with the resilient strip compressed and the rear edge of the elongated hole engaging the retaining notch in the pin and the resilient strip is then released the locking projection will be disposed within the orifice and bear against the inner surface of the rigid plate, thereby securing the locking strip in the forward position and locking the pin within the first retaining strip and the second retaining strip; and whereby when the resilient strip is compressed against the locking strip the locking projection may pass through the orifice and the locking strip may be withdrawn rearwardly, thereby disengaging the elongated hole of the locking strip from the retaining notch and permitting the pin to be withdrawn upwardly from the hole in the first retaining strip and the second retaining strip.

5. An athletic shoe as described in claim 1, wherein the means for adjustably closing and tightening the ankle enclosing section comprises:

at least one flexible strap of a predetermined length and having a first end and a second end;

said flexible strap being fixedly attached at the first end to the outer side of the ankle enclosing section;

said flexible strap having a hooking strip attached at said second end;

a loop strip fixedly attached to the inner side of the ankle enclosing section, said loop strip positioned so as to detachably engage said hooking strip when the flexible strap is disposed across the ankle enclosing section; and whereby when the wearer's foot is inserted into the shoe the flexible strap may be drawn across the ankle enclosing section and adjustably secure the closure thereof.

6. An athletic shoe as described in claim 1, wherein the means for securing said toe enclosing section to said ankle enclosing section comprises:

at least one loop strip fixedly attached to the top portion of the ankle enclosing section adjacent the forward area;

at least one hooking strip affixed to the bottom surface of the toe enclosing section adjacent the back end thereof and positioned to detachably engage the loop strip attached to the ankle enclosing section;

whereby when the hingedly attached toe enclosing section is secured over the wearer's toes and forefoot the hooking and loop strips serve to secure the toe enclosing section to the ankle enclosing section; and whereby when the hingedly attached toe enclosing section is opened upwardly the wearer may rapidly remove his foot.

7. An athletic shoe as described in claim 1 wherein the toe enclosing section further comprises at least one resilient reinforcing member affixed to the bottom surface thereof, said reinforcing member serving to provide a measure of rigidity to the toe enclosing section and protection for the forefoot and toes of the wearer.

* * * * *